US007541981B2

(12) United States Patent
Piskun

(10) Patent No.: US 7,541,981 B2
(45) Date of Patent: Jun. 2, 2009

(54) FRACTAL ANTENNA BASED ON PEANO-GOSPER CURVE

(75) Inventor: Vadim Piskun, San Jose, CA (US)

(73) Assignee: Broadcom Corporation, Irvine, CA (US)

( * ) Notice: Subject to any disclaimer, the term of this patent is extended or adjusted under 35 U.S.C. 154(b) by 209 days.

(21) Appl. No.: 11/648,448

(22) Filed: Dec. 28, 2006

(65) Prior Publication Data

US 2008/0084352 A1 Apr. 10, 2008

Related U.S. Application Data

(60) Provisional application No. 60/849,269, filed on Oct. 4, 2006.

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,710,744 | B2 * | 3/2004 | Morris et al. | 343/700 MS |
| 6,885,264 | B1 * | 4/2005 | Vincent et al. | 333/204 |
| 6,975,277 | B2 * | 12/2005 | Tran | 343/792.5 |
| 2004/0017317 | A1 * | 1/2004 | Schmiade | 343/700 MS |
| 2008/0062049 | A1 * | 3/2008 | Soler Castany et al. | 343/702 |

OTHER PUBLICATIONS

"An Overview of Fractal Antenna Engineering Research"; Werner & Ganguly; IEEE Antennas and Propagation Magazine, vol. 45, No. 1, Feb. 2003; pp. 38-57.

"The Peano-Gosper Fractal Array"; Werner et al.; IEEE Transactions on Antennas and Propagation, vol. 51, No. 8, Aug. 2003; pp. 2063-2072.

* cited by examiner

*Primary Examiner*—Tho G Phan
(74) *Attorney, Agent, or Firm*—Garlick Harrison & Markison

(57) ABSTRACT

A fractal antenna array based on a modified Peano-Gosper curve. The fractal antenna array is constructed using a 100-segment fractal curve that has the fractal expansion in a linear direction.

20 Claims, 7 Drawing Sheets

FRACTAL ANTENNA BASED ON PEANO-GOSPER CURVE

CROSS REFERENCE TO RELATED APPLICATION

This application claims the benefit of priority to U.S. Provisional Patent Application Ser. No. 60/849,269; filed Oct. 4, 2006; and titled "Fractal antenna based on Peano-Gosper curve" which is incorporated herein by reference.

BACKGROUND OF THE INVENTION

1. Technical Field of the Invention

The embodiments of the invention relate to communications and more particularly to a construction of fractal antennas.

2. Description of Related Art

Communication systems are known to support wireless and wire lined communications between wireless and/or wire lined communication devices. Such communication systems range from national and/or international cellular telephone systems, the Internet and to point-to-point in-home wireless networks. Each type of communication system is constructed, and hence operates, in accordance with one or more communication standards. For instance, wireless communication systems may operate in accordance with one or more standards including, but not limited to, IEEE 802.11, Bluetooth, advanced mobile phone services (AMPS), digital AMPS, global system for mobile communications (GSM), code division multiple access (CDMA), local multi-point distribution systems (LMDS), multi-channel-multi-point distribution systems (MMDS), and/or variations thereof.

Depending on the type of wireless communication system, a wireless communication device, such as a cellular telephone, two-way radio, personal digital assistant (PDA), personal computer (PC), laptop computer, home entertainment equipment, et cetera, communicates directly or indirectly with other wireless communication devices. For direct communications (also known as point-to-point communications), the participating wireless communication devices tune their receivers and transmitters to the same channel or channels (e.g., one of the plurality of radio frequency (RF) carriers of the wireless communication system) and communicate over that channel(s). For indirect wireless communications, each wireless communication device communicates directly with an associated base station (e.g., for cellular services) and/or an associated access point (e.g., for an in-home or in-building wireless network) via an assigned channel. To complete a communication connection between the wireless communication devices, the associated base stations and/or associated access points communicate with each other directly, via a system controller, via a public switch telephone network, via the Internet, and/or via some other wide area network.

For each wireless communication device to participate in wireless communications, it typically includes a built-in radio transceiver (i.e., receiver and transmitter) or is coupled to an associated radio transceiver (e.g., a station for in-home and/or in-building wireless communication networks, RF modem, etc.). The receiver may be coupled to an antenna and the receiver may include a low noise amplifier, one or more intermediate frequency stages, a filtering stage, and a data recovery stage. The low noise amplifier receives inbound RF signals via the antenna and amplifies them. The one or more intermediate frequency stages mix the amplified RF signals with one or more local oscillators to convert the amplified RF signal into baseband signals or intermediate frequency (IF) signals. The filtering stage filters the baseband signals or the IF signals to attenuate unwanted out of band signals to produce filtered signals. The data recovery stage recovers raw data from the filtered signals in accordance with the particular wireless communication standard.

The transmitter typically includes a data modulation stage, one or more intermediate frequency stages, and a power amplifier stage. The data modulation stage converts raw data into baseband signals in accordance with a particular wireless communication standard. The one or more intermediate frequency stages mix the baseband signals with one or more local oscillators to produce RF signals. The power amplifier amplifies the RF signals prior to transmission via an antenna.

In traditional wireless systems, the transmitter may include one antenna for transmitting the RF signals, which are received by a single antenna, or multiple antennas, of a receiver. When the receiver includes two or more antennas, the receiver generally selects one of them to receive the incoming RF signals. In this instance, the wireless communication between the transmitter and receiver is a single-output-single-input (SISO) communication, even if the receiver includes multiple antennas that are used as diversity antennas (i.e., selecting one of them to receive the incoming RF signals). For SISO wireless communications, a transceiver includes one transmitter and one receiver. Currently, most wireless local area networks (WLAN) that are IEEE 802.11, 802.11a, 802,11b, or 802.11g employ SISO wireless communications.

Other types of wireless communications include single-input-multiple-output (SIMO), multiple-input-single-output (MISO), and more recently, multiple-input-multiple-output (MIMO). In a SIMO wireless communication, a single transmitter processes data into radio frequency signals that are transmitted to a receiver. The receiver includes two or more antennas and two or more receiver paths. Each of the antennas receives the RF signals and provides them to a corresponding receiver path (e.g., LNA, down conversion module, filters, and ADCs). Each of the receiver paths processes the received RF signals to produce digital signals, which are combined and then processed to recapture the transmitted data.

For a multiple-input-single-output (MISO) wireless communication, the transmitter includes two or more transmission paths (e.g., digital to analog converter, filters, up-conversion module, and a power amplifier) that each converts a corresponding portion of baseband signals into RF signals, which are transmitted via corresponding antennas to a receiver. The receiver includes a single receiver path that receives the multiple RF signals from the transmitter.

For a multiple-input-multiple-output (MIMO) wireless communication, the transmitter and receiver each include multiple paths. In such a communication, the transmitter parallel processes data using a spatial and time encoding function to produce two or more streams of data. The transmitter includes multiple transmission paths to convert each stream of data into multiple RF signals. The receiver receives the multiple RF signals via multiple receiver paths that recapture the streams of data utilizing a spatial and time decoding function. The captured receive signals are jointly processed to recover the original data.

With the various types of wireless communications (e.g., SISO, MISO, SIMO, and MIMO) and standards (e.g., IEEE 802.11, IEEE 802.11a, IEEE 802.11b, IEEE 802.11g, IEEE 802.11n, extensions and modifications thereof), a large number of combination of types and standards is possible. With the various types of communication schemes employed for wireless communication, an antenna is typically employed to transmit and/or receive RF signals. In some instances, multiple antennas are employed, such as with a device implementing MIMO communications. Although early wireless devices operated adequately with the use of external antennas, the present trend is to incorporate the antenna internally to the device. Typical practice is to incorporate the antenna as either part of the circuit board that contains the RF integrated circuit or as part of the integrated circuit itself. With the advent of placing a complete system on a chip ("system on a chip" or SoP), the intent is to also place an antenna also within the same chip).

Whether the antenna is placed on a circuit board, substrate or within a chip, the practice of integrating an antenna within a wireless device generally entails for the antenna to be much smaller in size. One antenna construction technique uses fractal antennas for use in design of smaller antennas. A fractal is a term associated with broken or irregular fragments or segments and curve names are attributed to various unique fractal patterns. Furthermore, the recursion of a particular fractal pattern results in larger geometries of the fractal that may be repeated infinitely. The resulting larger fractal pattern may then be used to design a fractal antenna array.

Accordingly, there is a need for fractal antennas and unique fractal designs that improve the performance of fractal antennas.

SUMMARY OF THE INVENTION

The present invention is directed to apparatus and methods of operation that are further described in the following Brief Description of the Drawings, the Detailed Description of the Embodiments of the Invention, and the Claims. Other features and advantages of the present invention will become apparent from the following detailed description of the embodiments of the invention made with reference to the accompanying drawings.

DETAILED DESCRIPTION OF THE EMBODIMENTS OF THE INVENTION

The embodiments of the present invention may be practiced in a variety of settings that implement a fractal antenna and, particularly to fractal antenna arrays based on a modified Peano-Gosper curve.

Figure 1:
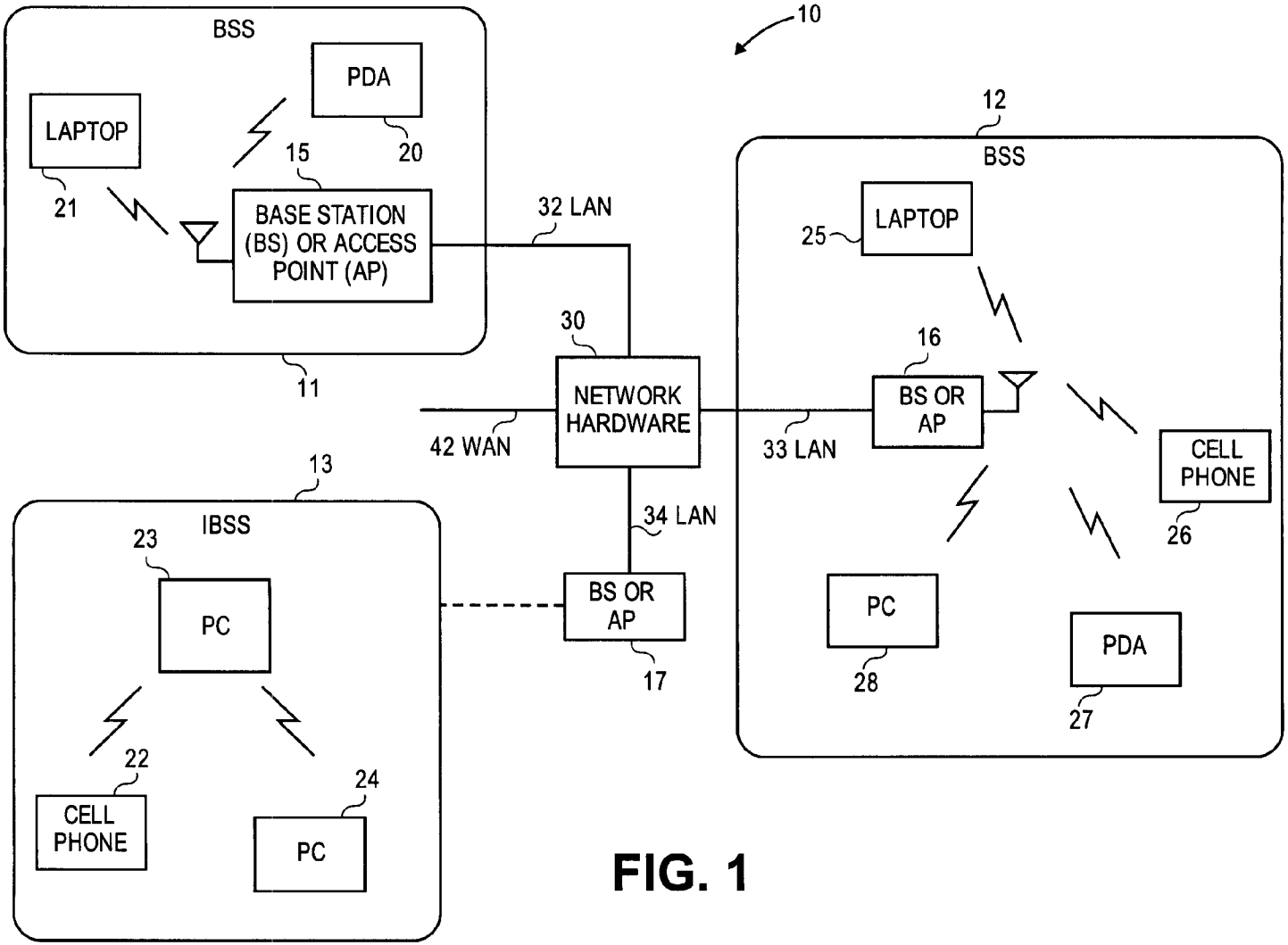
FIG. 1 is a block schematic diagram illustrating a wireless communication system in accordance with one embodiment of the present invention.

FIG. 1 is a schematic block diagram illustrating a communication system 10 that includes a plurality of base stations and/or access points (BS/AP) 15, 16, 17, a plurality of wireless communication devices 20-28 and a network hardware component 30. Network hardware component 30, which may be a router, switch, bridge, modem, system controller, et cetera, may provide a wide area network (WAN) coupling 31 for communication system 10. Furthermore, wireless communication devices 20-28 may be of a variety of devices, including laptop computers 21, 25; personal digital assistants (PDA) 20, 27; personal computers (PC) 23, 24, 28; and/or cellular telephones (cell phone) 22, 26. The details of the wireless communication devices shown is described in greater detail with reference to FIG. 2.

Wireless communication devices 22, 23, and 24 are shown located within an independent basic service set (IBSS) area 13 and these devices communicate directly (i.e., point to point). In this example configuration, these devices 22, 23, and 24 typically communicate only with each other. To communicate with other wireless communication devices within system 10 or to communicate outside of system 10, devices 22-24 may affiliate with a base station or access point, such as BS/AP 17, or one of the other BS/AP units 15, 16.

BS/AP 15, 16 are typically located within respective basic service set (BSS) areas 11, 12 and are directly or indirectly coupled to network hardware component 30 via local area network (LAN) couplings 32, 33. Such couplings provide BS/AP 15, 16 with connectivity to other devices within system 10 and provide connectivity to other networks via WAN connection 31. To communicate with the wireless communication devices within its respective BSS 11, 12, each of the BS/AP 15, 16 has an associated antenna or antenna array. For instance, BS/AP 15 wirelessly communicates with wireless communication devices 20, 21, while BS/AP 16 wirelessly communicates with wireless communication devices 25-28. Typically, the wireless communication devices register with a particular BS/AP 15, 16 to receive services within communication system 10. As illustrated, when BS/AP 17 is utilized with IBSS area 13, LAN coupling 17 may couple BS/AP 17 to network hardware component 30.

Typically, base stations are used for cellular telephone systems and like-type systems, while access points are used for in-home or in-building wireless networks (e.g., IEEE 802.11 and versions thereof, Bluetooth, and/or any other type of radio frequency based network protocol). Regardless of the particular type of communication system, each wireless communication device includes a built-in radio and/or is coupled to a radio.

Figure 2:
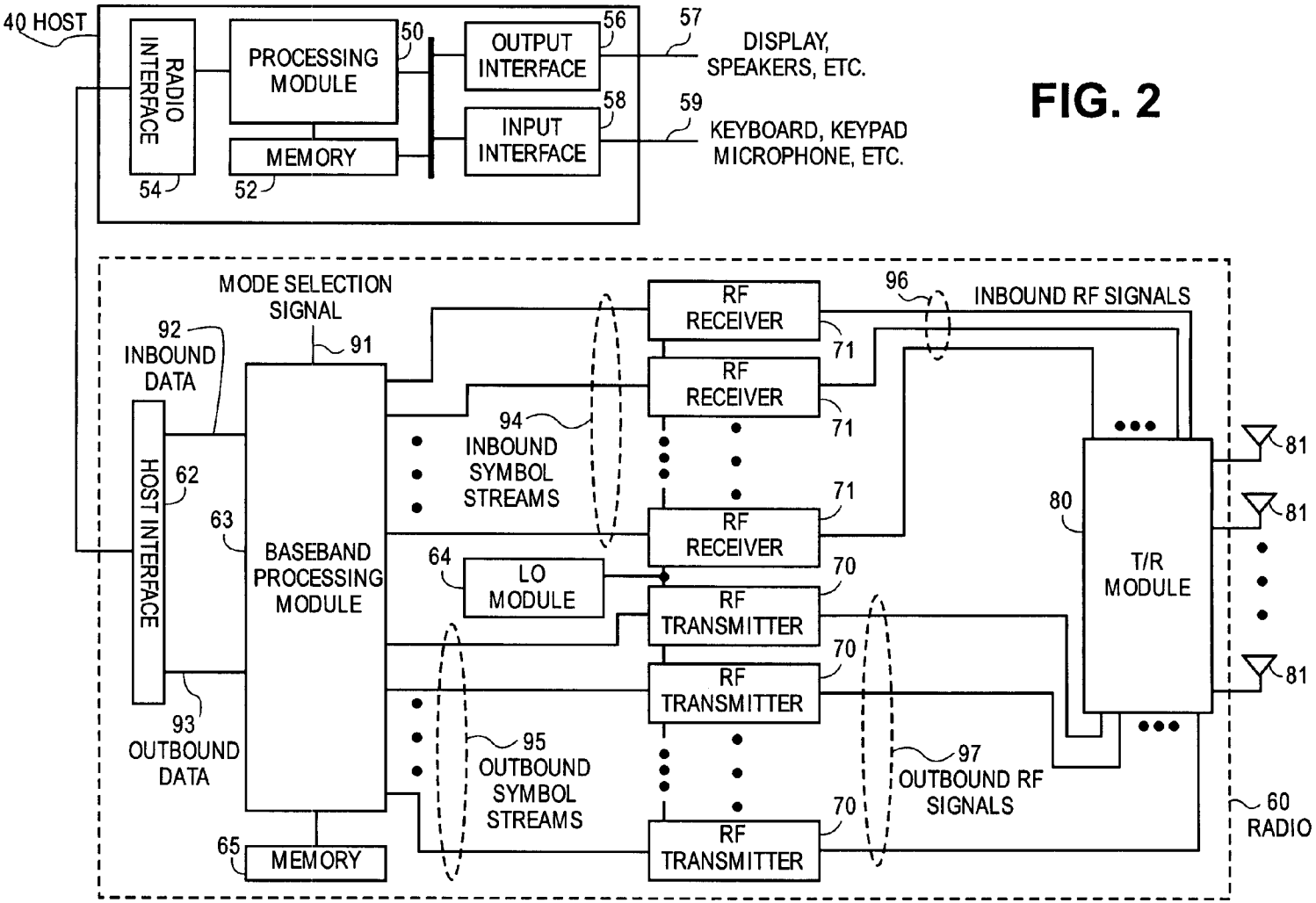
FIG. 2 is a block schematic block diagram illustrating a wireless communication apparatus in accordance with one embodiment of the present invention.

FIG. 2 is a schematic block diagram illustrating a wireless communication device that includes a host 40 and an associated radio 60. Host 40 may be one of the devices 20-28 shown in FIG. 1. For cellular telephone hosts, radio 60 is typically a built-in component. For personal digital assistant hosts, laptop hosts, and/or personal computer hosts, radio 60 may be built-in or an externally coupled component.

As illustrated, host 40 includes a processing module 50, memory 52, radio interface 54, input interface 58 and output interface 56. Processing module 50 and memory 52 execute corresponding instructions that are typically done by the host device. For example, for a cellular telephone host device, processing module 50 may perform the corresponding communication functions in accordance with a particular cellular telephone standard.

Generally, radio interface 54 allows data to be received from and sent to radio 60. For data received from radio 60 (such as inbound data 92), radio interface 54 provides the data to processing module 50 for further processing and/or routing to output interface 56. Output interface 56 provides connectivity on line 57 to an output device, such as a display, monitor, speakers, et cetera, in order to output the received data. Radio interface 54 also provides data from processing module 50 to radio 60. Processing module 50 may receive outbound data on line 59 from an input device, such as a keyboard, keypad, microphone, et cetera, via input interface 58 or generate the data itself. For data received via input interface 58, processing module 50 may perform a corresponding host function on the data and/or route it to radio 60 via radio interface 54.

Radio 60 includes a host interface 62, a baseband processing module 63, memory 65, one or more radio frequency (RF) transmitter units 70, a transmit/receive (T/R) module 80, one or more antennas 81, one or more RF receivers 71 and a local oscillation (LO) module 64. Baseband processing module 63, in combination with operational instructions stored in memory 65, executes digital receiver functions and digital transmitter functions. The digital receiver functions include, but are not limited to, digital intermediate frequency to baseband conversion, demodulation, constellation demapping, decoding, de-interleaving, fast Fourier transform, cyclic prefix removal, space and time decoding, and/or descrambling. The digital transmitter functions include, but are not limited to, scrambling, encoding, interleaving, constellation mapping, modulation, inverse fast Fourier transform, cyclic prefix addition, space and time encoding, and digital baseband to IF conversion.

Baseband processing module 63 may be implemented using one or more processing devices. Such processing device(s) may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions.

Memory 65 may be a single memory device or a plurality of memory devices. Such a memory device may be a read-only memory, random access memory, volatile memory, non-volatile memory, static memory, dynamic memory, flash memory, and/or any device that stores digital information. Note that when processing module 63 implements one or more of its functions via a state machine, analog circuitry, digital circuitry, and/or logic circuitry, the memory storing the corresponding operational instructions may be embedded with the circuitry comprising the state machine, analog circuitry, digital circuitry, and/or logic circuitry.

In operation, radio 60 receives outbound data 93 from host 40 via host interface 62. Baseband processing module 63 receives outbound data 93 and based on a mode selection signal 91, produces one or more outbound symbol streams 95. Mode selection signal 91 typically indicates a particular mode of operation that is compliant with one or more specific modes of the various IEEE 802.11 standards. For example, in one embodiment mode selection signal 91 may indicate a frequency band of 2.4 GHz, a channel bandwidth of 20 or 22 MHz and a maximum bit rate of 54 megabits-per-second. In this general category, mode selection signal 91 may further indicate a particular rate ranging from 1 megabit-per-second to 54 megabits-per-second, or higher.

In addition, mode selection signal 91 may indicate a particular type of modulation, which includes, but is not limited to, Barker Code Modulation, BPSK, QPSK, CCK, 16 QAM and/or 64 QAM, as well as others. Mode selection signal 91 may also include a code rate, a number of coded bits per subcarrier (NBPSC), coded bits per OFDM symbol (NCBPS), and/or data bits per OFDM symbol (NDBPS). Mode selection signal 91 may also indicate a particular channelization for the corresponding mode that provides a channel number and corresponding center frequency. Mode select signal 91 may further indicate a power spectral density mask value and a number of antennas to be initially used for a MIMO communication.

Baseband processing module 63, based on mode selection signal 91, produces one or more outbound symbol streams 95 from outbound data 93. For example, if mode selection signal 91 indicates that a single transmit antenna is being utilized for the particular mode that has been selected, baseband processing module 63 produces a single outbound symbol stream 95. Alternatively, if mode selection signal 91 indicates 2, 3 or 4 antennas, baseband processing module 63 produces respective 2, 3 or 4 outbound symbol streams 95 from outbound data 93.

Depending on the number of outbound symbol streams 95 (e.g. 1 to n) produced by baseband processing module 63, a corresponding number of RF transmitters 70 are enabled to convert outbound symbol stream(s) 95 into outbound RF signals 97. Generally, each RF transmitter 70 includes a digital filter and up sampling module, a digital to analog conversion module, an analog filter module, a frequency up conversion module, a power amplifier, and a radio frequency bandpass filter. RF transmitters 70 provide outbound RF signals 97 to T/R module 80, which provides each outbound RF signal 97 to a corresponding antenna 81.

When radio 60 is in the receive mode, T/R module 80 receives one or more inbound RF signals 96 via antenna(s) 81 and provides signal(s) 96 to respective one or more RF receivers 71. RF receiver(s) 71 converts inbound RF signals 96 into a corresponding number of inbound symbol streams 94. The number of inbound symbol streams 94 corresponds to the particular mode in which the data was received. Baseband processing module 63 converts inbound symbol streams 94 into inbound data 92, which is provided to host 40 via host interface 62.

The wireless communication device of FIG. 2 may be implemented using one or more integrated circuits. For example, host 40 may be implemented on one integrated circuit, baseband processing module 63 and memory 65 may be implemented on a second integrated circuit, and the remaining components of radio 60 (less the antennas 81) may be implemented on a third integrated circuit. As an alternative embodiment, baseband processing module 63 and radio 60 may be implemented on a single integrated circuit. In another embodiment, processing module 50 of host 40 and baseband processing module 63 may be a common processing device implemented on a single integrated circuit. Furthermore, memory 52 and memory 65 may be implemented on the same memory device and/or on the same integrated circuit as the common processing modules of processing module 50 and baseband processing module 63. It is be noted that other embodiments may be implemented with the various units of FIG. 2.

The various embodiments of the wireless communication device of FIG. 2 may be implemented in a transmitter and/or a receiver utilized for wireless communications. Typically, the communication is both ways so that the two units communicating typically will employ a transceiver in order to send and receive data. The multiple RF transmitters 70 and RF receivers 71 allow the device of FIG. 2 to be utilized in a multiple antenna transceiver system. FIG. 3 shows one particular example when communication is achieved using two antennas at the transmitter and two antennas at the receiver.

In reference to antenna 81 (or antennas, depending on how many are present), it may be externally disposed to radio 60 or provided as part of an integrated circuit that comprises radio 60. Although a variety of antennas may be implemented for antenna 81, in one scheme, a fractal antenna is used. For example, a fractal antenna may be constructed within the integrated circuit comprising radio 60 or, alternatively, the fractal antenna may be constructed externally, such as on a circuit board (or other substrate) that also holds radio 60. In one embodiment, a fractal antenna based on a modified Peano-Gosper curve, as described below, may be employed for antenna 81.

Figure 3B:
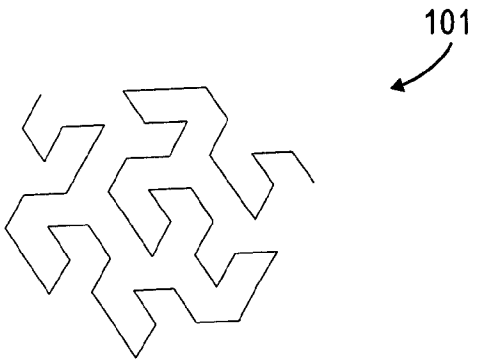
FIG. 3B is a diagram illustrating a 49-segment fractal curve that forms the second stage of the Peano-Gosper fractal.
Figure 3A:
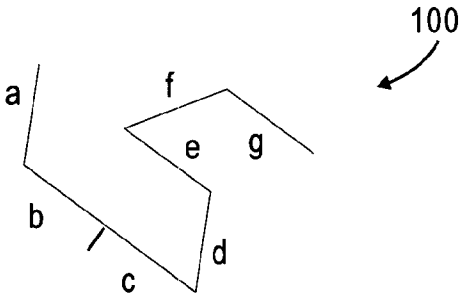
FIG. 3A is a diagram illustrating a 7-segment fractal curve that forms an originator stage of the Peano-Gosper fractal.

FIG. 3A shows a particular fractal 100 which has a curve shape that is referred to as a Peano-Gosper (P-G) curve. Fractal 100 is comprised of seven segments labeled a-g. The seven segments ($7^1$) have equal length and form the first stage (originator stage) of the P-G curve. Note that the long length portion of the P-G fractal 100 is actually formed by two segments b and c. This originator fractal 100 is then utilized to generate subsequent stages of the P-G geometry as recursions are employed to expand the P-G curve.

Figure 3D:
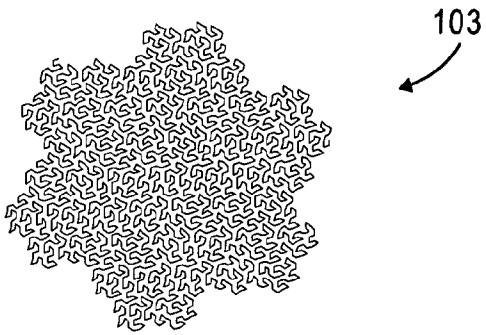
FIG. 3D is a diagram illustrating a 2401-segment fractal curve that forms the fourth stage of the Peano-Gosper fractal.
Figure 3C:
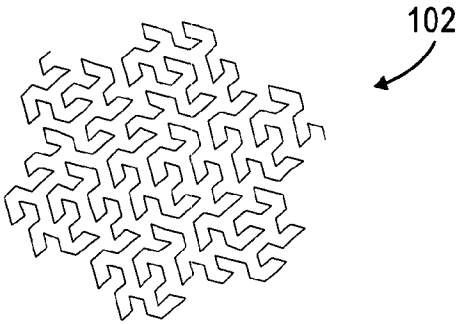
FIG. 3C is a diagram illustrating a 343-segment fractal curve that forms the third stage of the Peano-Gosper fractal.

FIG. 3B shows a first recursion of the P-G curve subsequent to the originator fractal 100 shown in FIG. 3A. First recursion (second stage) of the P-G curve is shown as fractal array 101. Note that fractal array 101 has 49 ($7^2$) segments formed by seven 7-segment fractals. In a crude explanation, fractal array 101 has one 7-segment fractal in the center, circumscribed by the remaining six 7-segment fractals. A subsequent second recursion (third stage) of the P-G curve is shown as fractal array 102 in FIG. 3C. Note that fractal 102 has 343 ($7^3$) segments formed by seven 49-segment fractals, in which six 49-segment fractals 101 circumscribe the one 49-segment fractal in the center. FIG. 3D shows a third recursion (fourth stage) of the P-G curve in fractal array 103. Fractal array 103 has 2401 ($7^4$) segments formed by seven 343-segment fractals, in which six 343-segment fractals 102 circumscribe the one 343-segment fractal in the center. The next recursion (not shown) would be a fractal array comprised of seven 2401-segment fractals 103, in which six such fractals 103 would circumscribe the center fractal. The process may be repeated infinitely in a similar manner for subsequent recursions.

As illustrated in FIGS. 3A-3D, each recursion growth of the P-G curve results in a previous fractal array being duplicated in a similar geometric pattern, having one fractal array in the center circumscribed by six other identical fractal arrays. The growth in all instances is outwardly from the center in a substantially omni-directional expansion of the geometric P-G pattern. When fractal antennas are designed using one of the recursions of the P-G curve, the resulting antenna employs one of the patterns shown in FIGS. 3A-3D, or one of the subsequent recursion.

Figure 4B:
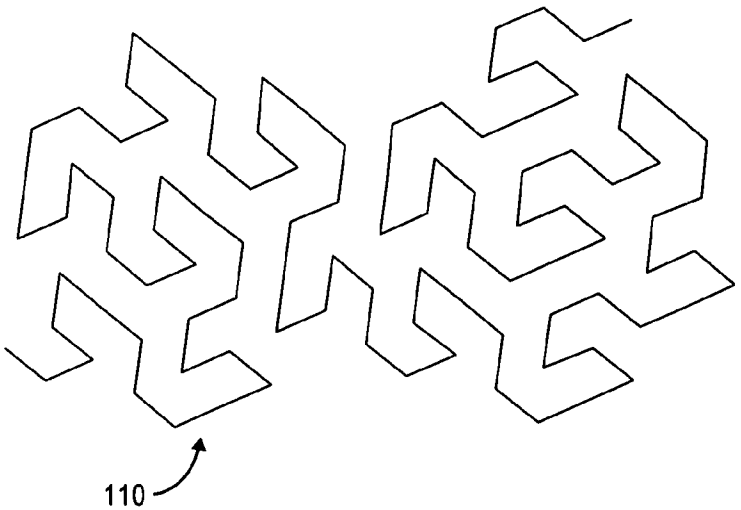
FIG. 4B shows the 100-segment fractal of FIG. 4A.
Figure 4A:
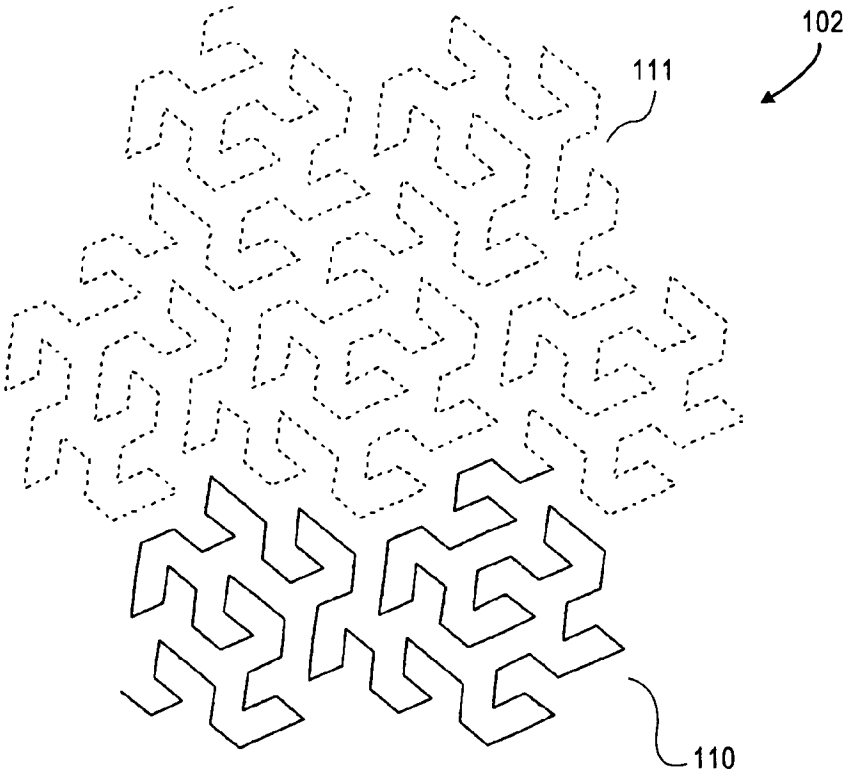
FIG. 4A is a diagram showing a 100-segment portion of the 343-segment Peano-Gosper fractal curve of FIG. 3C that is used to form a fractal antenna for one embodiment of the present invention.

FIG. 4A-4B illustrate a fractal design utilizing a modified P-G curve. As noted below, one embodiment for constructing a fractal antenna utilizes this modified P-G curve. In FIG. 4A, a 343-segment fractal array 102 of FIG. 3C is shown again. However, instead of using all 343 segments, only 100 segments out of the total 343 segments are utilized. The 100-segment fractal 110 is shown in solid lines and the remaining unused portion 111 is shown in dotted lines in FIG. 4A. Fractal 110 is shown enlarged in FIG. 4B.

As illustrated in FIG. 4B, the 100-segment fractal design of fractal 110 is obtained from two of the adjacent border 49-segment fractals plus 2 additional segments. Thus, the dimensions are such that fractal 110 has a cross-section that is longer in length than its width, which is unlike the circular cross-section of the standard P-G curve. Accordingly, in one embodiment, a fractal antenna is constructed using this 100-segment portion of the P-G curve.

Figure 5:
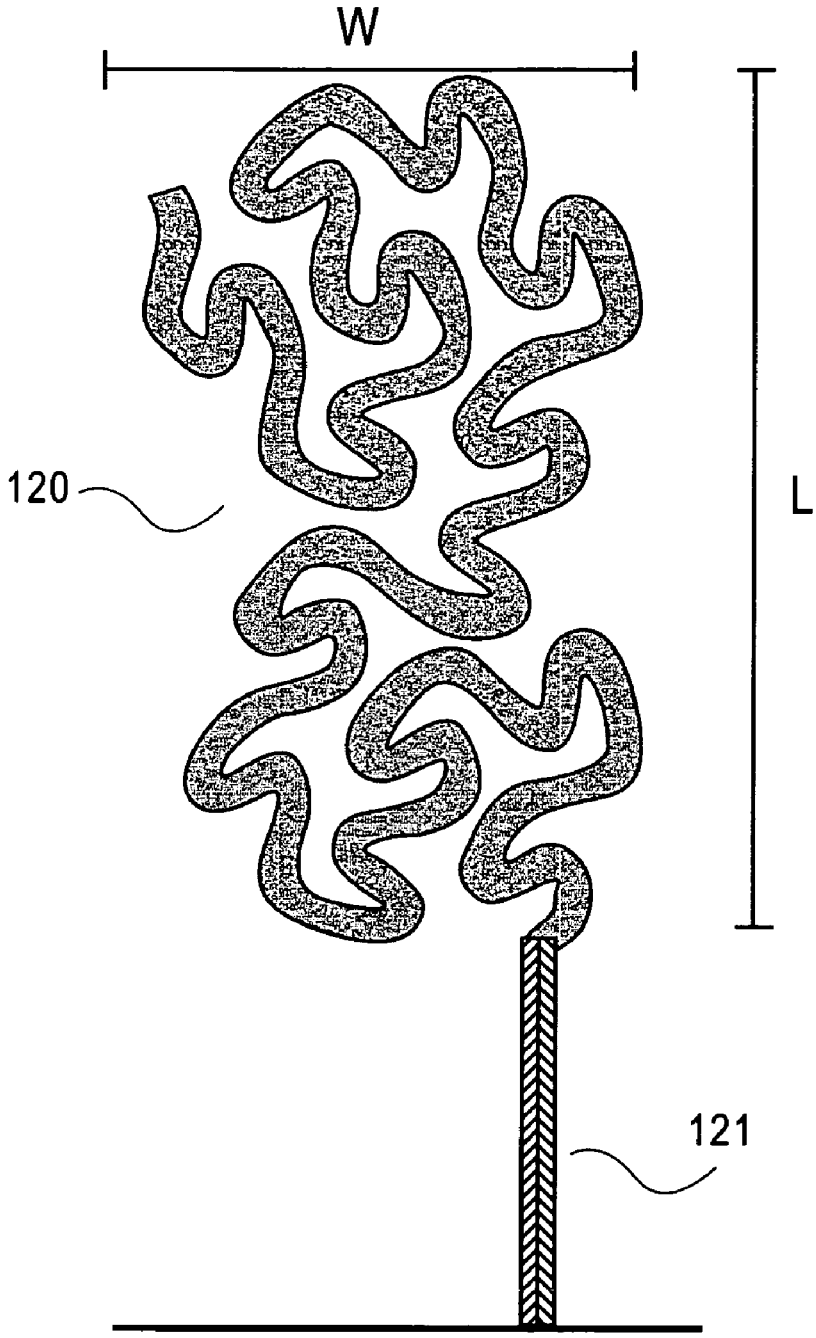
FIG. 5 shows the implementation of the 100-segment fractal of FIG. 4B to construct a modified Peano-Gosper fractal antenna array, in which the particular embodiment shown implements rounded corners to remove sharp discontinuities at segment joints.

FIG. 5 shows one embodiment of a fractal antenna array 120 constructed using the 100-segment modified P-G curve of FIG. 4B. As noted, dimension of length L is longer than the dimension of width W. A conductive lead 121 is also shown to couple the fractal antenna array 120 to RF components and/or circuitry. Furthermore, the embodiment of FIG. 5 shows an implementation in which corners where the segments join are rounded to remove the sharp discontinuity. It is to be noted that other embodiments may use the specific design of FIG. 4B, in which the segment corners are not rounded.

Figure 6:
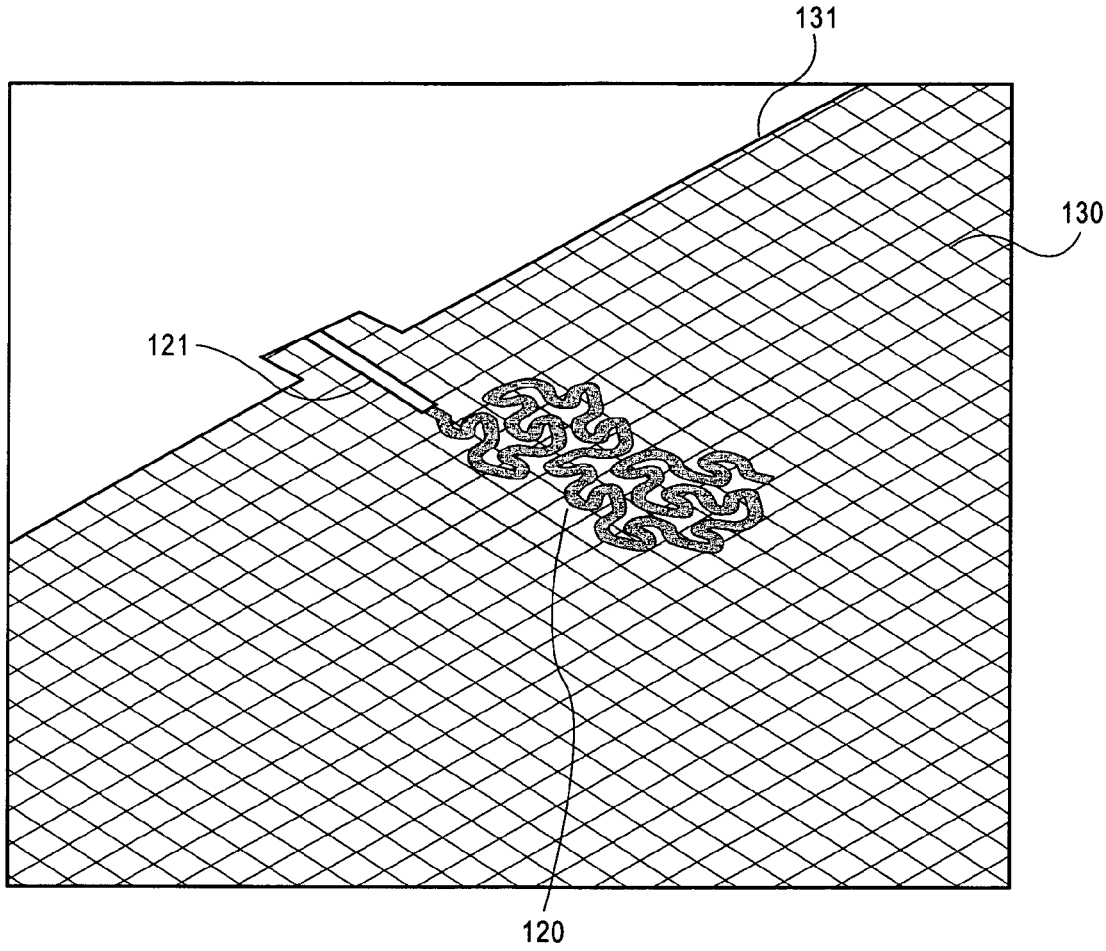
FIG. 6 is a diagram illustrating a placement of a 100-segment fractal antenna array of FIG. 5 on a dielectric substrate to form a monopole antenna.

The fractal antenna array 120 (whether employing the rounded corner design or retaining the sharp corner design) may be implemented in a variety of ways to perform as an antenna. The antenna array 120 may be implemented in the integrated circuit itself with the RF circuitry; implemented separately from the integrated circuit, but in the same module or package; implemented on a substrate or circuit board on which the RF circuitry is resident; or implemented as a completely separate antenna. FIG. 6 shows antenna 120, with lead 121, implemented on a printed circuit board (PCB) 130, in which lead 121 is used to couple antenna 120 to integrated circuit 131, which is also disposed on PCB 130. As an example, in one embodiment, a 100-segment modified fractal antenna array made from a copper material has dimensions of approximately 349 mils for length L and 208 mils for width W. This antenna is then disposed on a PCB made from a FR4 dielectric to operate at or near a frequency of approximately 2.4 GHz.

Figure 7:
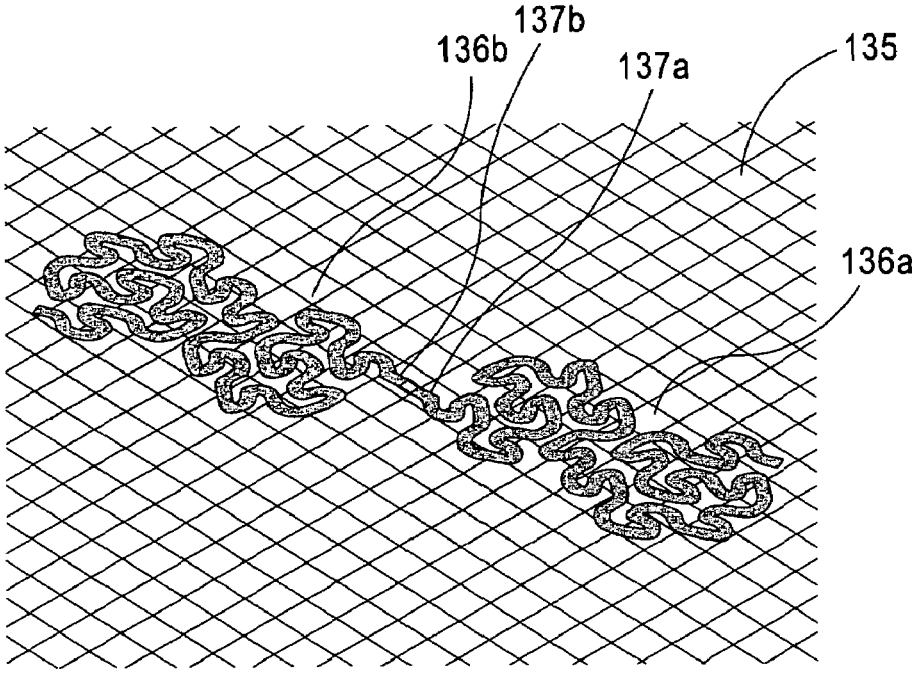
FIG. 7 is a diagram illustrating a placement of two 100-segment fractal antenna array of FIG. 5 on a dielectric substrate to form a dipole antenna.

FIG. 6 shows a monopole antenna design. However, in some instances, a dipole antenna design may be desired. Accordingly, FIG. 7 illustrates the use of two 100-segment P-G curve fractal antennas to form a dipole antenna. As shown a pair of 100-segment P-G curve fractal antenna arrays 136*a*-136*b*, with corresponding leads 137*a*-137*b*, are formed on a substrate or PCB 135. Leads 137*a*-137*b* would then be coupled to appropriate circuitry.

The design of the fractal antenna array using the modified 100-segment P-G curve allows for an antenna that has a length dimension L that is longer than the width dimension W (shown in FIG. 5). When fractal antennas use the standard P-G curve, the antenna construction is obtained from uniform expansion of the fractal, and in which the uniform radiation pattern may lead to cancellation effects in the radiated electromagnetic field. However, the 100-segment modified design has growth in a linear direction, so that the field cancellation effects are reduced. One performance mark to evaluate such reduced cancellation effects is antenna efficiency, which is the ratio of radiated power to accepted power for the antenna. Performance indicators have shown that significant antenna power efficiency may be obtained with the use of a fractal antenna using a modified P-G curve, in which the modified design has a non-uniform fractal growth, such as expanding more in one linear direction (L) versus a corresponding perpendicular direction (W). Additionally, the fractal design may implement rounded corners, which may aid in reducing sharp changes or discontinuities of the radiated electromagnetic field.

It is to be noted that the fractal design described above uses a modified 100-segment P-G curve. The antenna design need not be limited to a 100-segment design or an approximate 100-segment curve (e.g. 100±n). It may be constructed from a P-G curve of higher (or lower) recursion. Furthermore, the antenna need not be limited to the use of a Peano-Gosper curve. Other embodiments may use other types of fractal curves. Generally, the modified curve is selected to have more fractal expansion in a linear direction so that the L and W dimensions are substantially different. The actual curve used and the number of segments selected may be dependent on the particular use of the antenna, frequency of operation and/or the radiation pattern desired. Additionally, the actual dimensions of the antenna, whether the 100 segment P-G curve or some other design, the dimensions of the antenna may be changed to obtained various electrical properties, including frequency of operation for the antenna.

Thus, a fractal antenna using a modified fractal curve, such as a modified P-G curve, is described. The antenna is constructed from materials that are used for typical antenna construction. For example, in one embodiment, the conductor is copper. Typically, the antenna is formed on a non-conductor, such as a dielectric material. The antenna may be employed in various devices, including wireless devices. In one embodiment, the fractal antenna is used for one or more antennas 81, shown in FIG. 2, which may be incorporated on one or more wireless devices, such as those wireless devices shown in FIG. 1. Embodiments of the described fractal antenna need not be limited to the circuitry of FIG. 2 or devices shown in FIG. 1.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "coupled" and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" indicates that an item includes one or more of power connections, input(s), output(s), etc., to perform one or more of its corresponding functions and may further include inferred coupling to one or more other items.

Furthermore, the term "module" is used herein to describe a functional block and may represent hardware, software, firmware, etc., without limitation to its structure. A "module" may be a circuit, integrated circuit chip or chips, assembly or other component configurations. Accordingly, a "processing module" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions and such processing device may have accompanying memory. A "module" may also be software or software operating in conjunction with hardware.

The embodiments of the present invention have been described above with the aid of functional building blocks illustrating the performance of certain functions. The boundaries of these functional building blocks have been arbitrarily defined for convenience of description. Alternate boundaries could be defined as long as the certain functions are appropriately performed. Similarly, flow diagram blocks and methods of practicing the embodiments of the invention may also have been arbitrarily defined herein to illustrate certain significant functionality. To the extent used, the flow diagram block boundaries and methods could have been defined otherwise and still perform the certain significant functionality. Such alternate definitions of functional building blocks, flow diagram blocks and methods are thus within the scope and spirit of the claimed embodiments of the invention. One of ordinary skill in the art may also recognize that the functional building blocks and other illustrative blocks, modules and components herein, may be implemented as illustrated or by discrete components, application specific integrated circuits, processors executing appropriate software and the like or any combination thereof.

I claim:

1. An apparatus comprising:

a non-conductive material; and a conductive material constructed to form an antenna in which the antenna has a shape determined by selecting a predetermined number of segments that form a fractional portion of a recursion stage of a fractal pattern, in which the predetermined number of segments are selected approximately from adjacent border arrays of the recursion stage of the fractal pattern, so that the recursion stage of the fractal pattern is modified to provide a modified fractal pattern that has fractal expansion prominently in one linear direction.

2. The apparatus of claim 1, wherein the modified fractal pattern is obtained from a portion of a recursion stage of a Peano-Gosper curve.

3. The apparatus of claim 2, wherein the modified fractal pattern has approximately 100 segments of the recursion stage of the Peano-Gosper curve that has approximately 343 segments.

4. The apparatus of claim 3, wherein the antenna has dimensions of approximately 349 mils in the one linear direction and approximately 208 mils in a corresponding perpendicular direction.

5. The apparatus of claim 2, wherein the modified fractal pattern has edges that are rounded.

6. The apparatus of claim 2 wherein the non-conductive material is a printed circuit board.

7. An apparatus comprising:

an integrated circuit that includes a radio frequency (RF) stage; and an antenna coupled to the RF stage in which the antenna has a shape determined by selecting a predetermined number of segments that form a fractional portion of a recursion stage of a fractal pattern, in which the predetermined number of segments are selected approximately from adjacent border arrays of the recursion stage of the fractal pattern, so that the recursion stage of the fractal pattern is modified to provide a modified fractal pattern that has fractal expansion prominently in one linear direction.

8. The apparatus of claim 7, wherein the modified fractal pattern is obtained from a portion of a recursion stage of a Peano-Gosper curve.

9. The apparatus of claim 8, wherein the modified fractal pattern has approximately 100 segments of the recursion stage of the Peano-Gosper curve that has approximately 343 segments.

10. The apparatus of claim 9, wherein the antenna has dimensions of approximately 349 mils in the one linear direction and approximately 208 mils in a corresponding perpendicular direction.

11. The apparatus of claim 9, wherein the modified fractal pattern has edges that are rounded.

12. The apparatus of claim 9 wherein antenna is constructed external to the integrated circuit.

13. The apparatus of claim 9 wherein antenna is constructed within the integrated circuit.

14. A method comprising:

forming a conductive material on a non-conductive surface to construct an antenna in which the antenna has a shape determined by selecting a predetermined number of segments that form a fractional portion of a recursion stage of a fractal pattern, in which the predetermined number of segments are selected approximately from adjacent border arrays of the recursion stage of the fractal pattern, so that the recursion stage of the fractal pattern is modified to provide a modified fractal pattern that has fractal expansion prominently in one linear direction; and coupling the antenna to a radio frequency circuit.

15. The method of claim 14, wherein the modified fractal pattern that is used to form the antenna is obtained from a portion of a recursion stage of a Peano-Gosper curve.

16. The method of claim 15, wherein the modified fractal pattern that is used to form the antenna has approximately 100 segments of the recursion stage of the Peano-Gosper curve that has approximately 343 segments.

17. The method of claim 16, wherein the antenna when formed has dimensions of approximately 349 mils in the one linear direction and approximately 208 mils in a corresponding perpendicular direction.

18. The method of claim 15, wherein when forming the antenna, the modified fractal pattern has curve edges of the antenna that are rounded.

19. The method of claim 15 wherein when forming the antenna, the antenna is formed on a printed circuit board.

20. The method of claim 15 wherein when forming the antenna, the antenna is formed within an integrated circuit.

* * * * *